US005980319A

United States Patent [19]

Yildiz et al.

[11] Patent Number: 5,980,319

[45] Date of Patent: Nov. 9, 1999

[54] MODULAR PLUG CONNECTORS

[75] Inventors: Zulkuf Yildiz, Unna; Oliver Hackel; Peter Schekalla, both of Wuppertal; Frank Michalski, Remscheid, all of Germany

[73] Assignee: Delphi Automotive Sys Deutschland GmbH, Wuppertal, Germany

[21] Appl. No.: 09/036,343

[22] Filed: Mar. 6, 1998

[30] Foreign Application Priority Data

Mar. 26, 1997 [DE] Germany ..... 197 12 831

[51] Int. Cl.[6] ..... H01R 13/40

[52] U.S. Cl. ..... 439/595; 439/701

[58] Field of Search ..... 439/595, 594, 439/752, 701

[56] References Cited

U.S. PATENT DOCUMENTS

| | | | |
|---|---|---|---|
| 4,158,473 | 6/1979 | Shearer | 439/518 |
| 5,122,081 | 6/1992 | Bogiel et al. | 439/595 |
| 5,344,347 | 9/1994 | Inoue et al. | 439/701 |
| 5,575,683 | 11/1996 | Saito et al. | 439/595 |
| 5,697,819 | 12/1997 | Hatagishi | 439/752 |

FOREIGN PATENT DOCUMENTS

| | | |
|---|---|---|
| 0590596A1 | of 0000 | European Pat. Off. . |
| 3526664C2 | of 0000 | Germany . |
| 3910117C1 | of 0000 | Germany . |
| 93 01 220 U 1 | of 0000 | Germany . |

*Primary Examiner*—Kheim Nguyen
*Assistant Examiner*—T C Patel
*Attorney, Agent, or Firm*—Patrick M. Griffin

[57] ABSTRACT

In order to design a plug connector made of a housing (2), housing modules (6, 7) and plug-in modules (33) in such a way that a readily assembled modular system is produced which fulfils the known requirements with regard to the sealing of contact parts and system sealing, the plug-in module (33) sliding along the housing modules (6, 7) can be inserted into hollow spaces (8, 9), wherein in one of their longitudinal walls (14, 15, 34, 35) the modules (6, 7, 33) are constructed with flaps (16, 17, 36, 37) which can be swivelled outwardly in the plug-in direction (S) for locking contact parts (10, 57).

13 Claims, 6 Drawing Sheets

MODULAR PLUG CONNECTORS

TECHNICAL FIELD

The invention starts from a plug connector according to the introductory part of claim 1.

BACKGROUND OF THE INVENTION

Such a plug connector is disclosed by EP 0590496 A1. The plug connector exhibits a contact part holder which is connected in one piece to the housing frame. A further contact part holder is constructed as a separate module and can be inserted into a hollow space in the housing frame in the plug-in direction of the contact parts parallel to the contact part holder fixed to the housing. In order to reduce the plugging forces when connecting the frequently multipole plug connector to the mating connector the plug surfaces of the two contact part holders are arranged in different planes so that a steplike, force-spreading connection ensues. The initial locking of the contact parts takes place by means of flexible fingers which project from a wall of the contact part cavity in question and catch in the contact part. After the complete plug connection has been produced pins arranged on the mating connector serve as blocking members for the flexible fingers. It is disadvantageous that there is no active secondary locking and that due to the aforementioned contact part locking the correct seating of the contact parts in the contact part cavities is only checked during connection to the mating connector. Incorrect or incomplete positioning requires a costly correction. Contact parts, especially contact pins, which project beyond the plug-in plane are protected only inadequately before and during fitting to the mating connector by a salient cup-shaped elongation of the housing wall. Individual contact parts can be mechanically damaged and give rise to repairs or malfunctions. Sealing of the individual units is not discernible.

DE 3526664 C2 discloses a plug connector in the housing of which a separate contact part holder is inserted. The contact parts are introduced into the contact part holder and provided with secondary locking by means of a swivelling, hinged flap. The contact part holder is then inserted into the housing and fixed in detachable manner with a flexible cantilever arm. No provision is made in a housing of this type for the integration of further contact part holders or contact part holders fixed to the housing. The construction of a modular system is not taken into consideration. Here also contact parts protruding from the plug-in plane are not protected against mechanical damage prior to fitting to the mating connector.

SUMMARY OF THE INVENTION

The object underlying the invention is to develop a plug connector according to the introductory part of claim 1 in such a way that a readily assembled and modular system is produced which fulfils the known requirements with regard to the locking of the contact parts and the sealing of the system.

This task is solved by the characteristics specified in the characterising part of claim 1.

The subject matter of claim 1 exhibits the advantage that the plug connector can be designed by the use of modules such that their size, their shape and the number of contact parts are variable. The handling of the plug-in module during initial assembly as well as in the event of servicing is simple and unambiguous. The secondary locking of the contact parts by means of pivotable flaps enables visual interrogation which at the same time indicates correct positioning of the contact parts. The introduction of the plug-in module into the hollow space in the housing is only possible as long as the secondary locking mechanism of the housing module is swivelled into the contact part cavities. Only when the flaps of the housing module are swung in correctly is it possible for the plug-in module to be pushed completely home and locked.

The characteristics of the invention can be implemented both on the plug as well as on the corresponding mating connector of a plug connector. Frequently the mating connector is constructed as a cup-shaped coupler so that after pushing in the plug the contact region is protectively surrounded.

Advantageous developments of the subject matter of claim 1 are specified in the subsidiary claims.

The shape of the hollow space matches the external shape of the plug-in module so that on the one hand precise guidance and on the other hand encoding is produced. When using several plug-in modules their design provides the possibility of unambiguous assignment to the corresponding cavities. Moreover, incompletely closed flaps of the plug-in modules are brought into their correct final position during introduction into the cavities provided the corresponding contact parts are correctly positioned.

For the production of the secondary locking of the corresponding contact part a pivotable flap provided with a lug is allocated to each contact part cavity. A simplification of fitting is provided by the combination of flaps arranged beside one another to form a one-piece and stable unit. To pivot the flaps only one procedure step is then required. This step, however, is only possible as long as all the contact parts are pushed in completely and positioned correctly. Variants in the arrangement of the flaps can be brought about by the type of locking, the orientation of the plug-in axis, the size or the number of the contact parts. To be able to adapt the modules to such circumstances the flaps can be arranged, eg on opposite longitudinal walls of the modules. Furthermore, parallel rows of contact part cavities are conceivable.

The flaps of the housing module are swivelled and engaged counter to the plug-in direction. A pin-like tool is introduced into the cavity from the plug-in side and pushes the flaps into their final position so that flush longitudinal walls are produced. Ideally the flaps or the flap units of a plug connector equipped with several housing modules are not swivelled individually, rather a single tool with the required number and arrangement of pins allows the swivelling of all the flaps in one procedural step.

The plug-in modules are fixed in the housing by means of elastically deflectable arms on the plug-in side of the housing which engage behind corresponding projections of the plug-in modules. Automatic deflection of the locking arm is achieved with a ramp rising in the plug-in direction. In the course of introduction the plug-in module slides along the ramp and pushes the arm elastically into an open space until the locking arm snaps back into the final position of the plug-in module and engages behind the projection of the housing module. The exchange of a module is possible from the plug-in side by pushing back the locking arm.

In many cases the front ends of the contact parts, especially when using contact pins, project over the plug-in plane of the plug-in modules and are accordingly always exposed to mechanical stresses. To avoid damage a cover cap is fastened to the plug-in plane of the plug-in modules immediately after the assembly of the contact parts. The introduction of the plug-in module into the hollow space of the housing is done by means of the cover cap. In this case the arm for locking the plug-in module does not have a ramp, in order to prevent the plug-in module being introduced without the cap. If the plug-in module is inserted without a cap the projection on the plug-in side of the plug-in module blocks further advancement. The cap on the other hand is constructed in the shape of a truncated cone and deflects the arms. The cap is to be regarded as a tool which is removed again immediately before the connection of the plug and the mating connector.

Various measures enable the use of the plug connector in moist environments. The seal surrounding the housing ensures the customary protection against the penetration of moisture. The manner of contact part locking makes a completely sealed system possible since outwith the sealing region no openings for inserts for locking the contact parts are necessary. Many plug connectors are equipped with contact parts which guarantee functions relevant to safety in motor vehicles, eg an air bag. Such plug connectors are subject to increased sealing requirements. To protect the sensitive region the corresponding module is surrounded on the plug-in side by an additional seal. To design this module and the necessary receptacle in the mating connector as simply as possible the module is arranged in the outer region of the plug connector. A longitudinal wall of the module is constructed as an extension of the housing wall. Consequently the receptacle in the mating connector is likewise in part constructed by the corresponding housing wall. The additional seal thus uses in part the same regions of the housing wall for sealing as the common seal so that that this "series connection" of seals fulfils the increased requirements in structurally simple and effective manner.

An outer housing which surrounds the housing offers additional protection against the effects of weather and mechanical stresses. Furthermore, depending on the external shape of the plug connector the outer housing can assume functions for connecting the plug and the mating connector. For example round plug connectors with bayonet locks or rectangular plug connectors with sliding mechanisms.

BRIEF DESCRIPTION OF THE DRAWINGS

The present invention will now be described, by way of example, with reference to the accompanying drawings, in which.

DESCRIPTION OF THE PREFERRED EMBODIMENT

Figure 8:
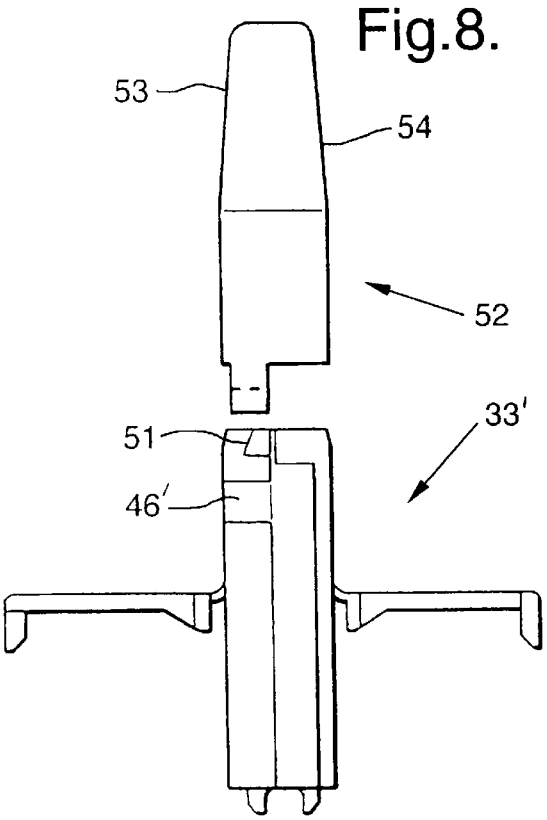
FIG. 8 is a side elevation of an unequipped plug-in module with open flaps and a cover cap.
Figure 9:
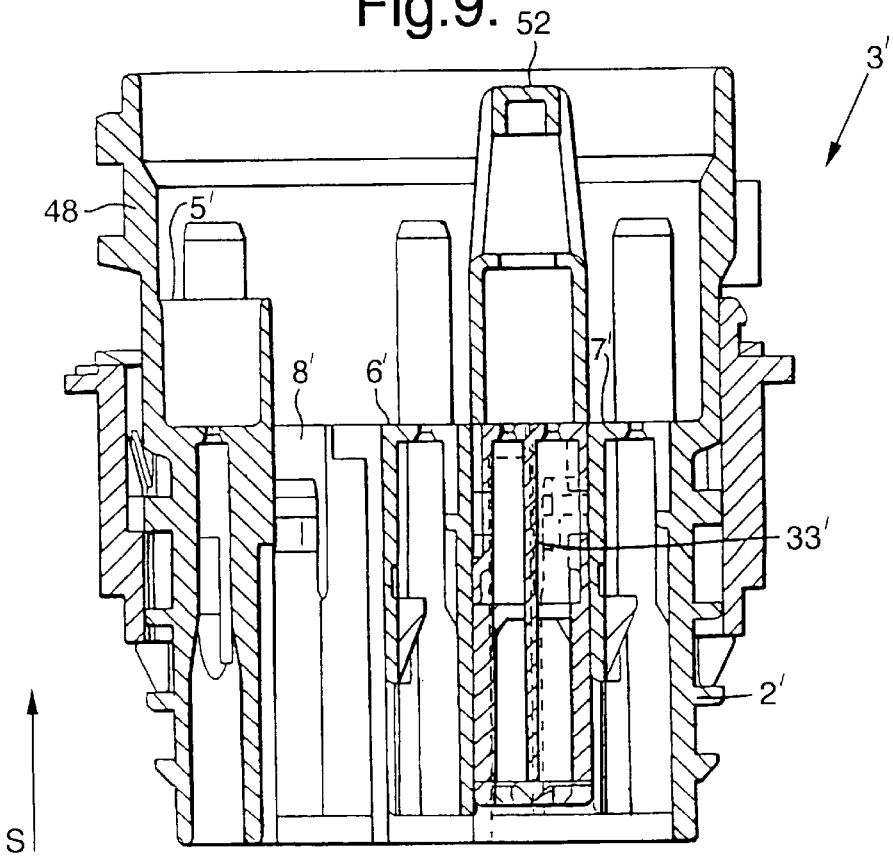
FIG. 9 is a longitudinal section through a further mating connector into which has been introduced an unequipped plug-in module with cover cap.
Figure 10:
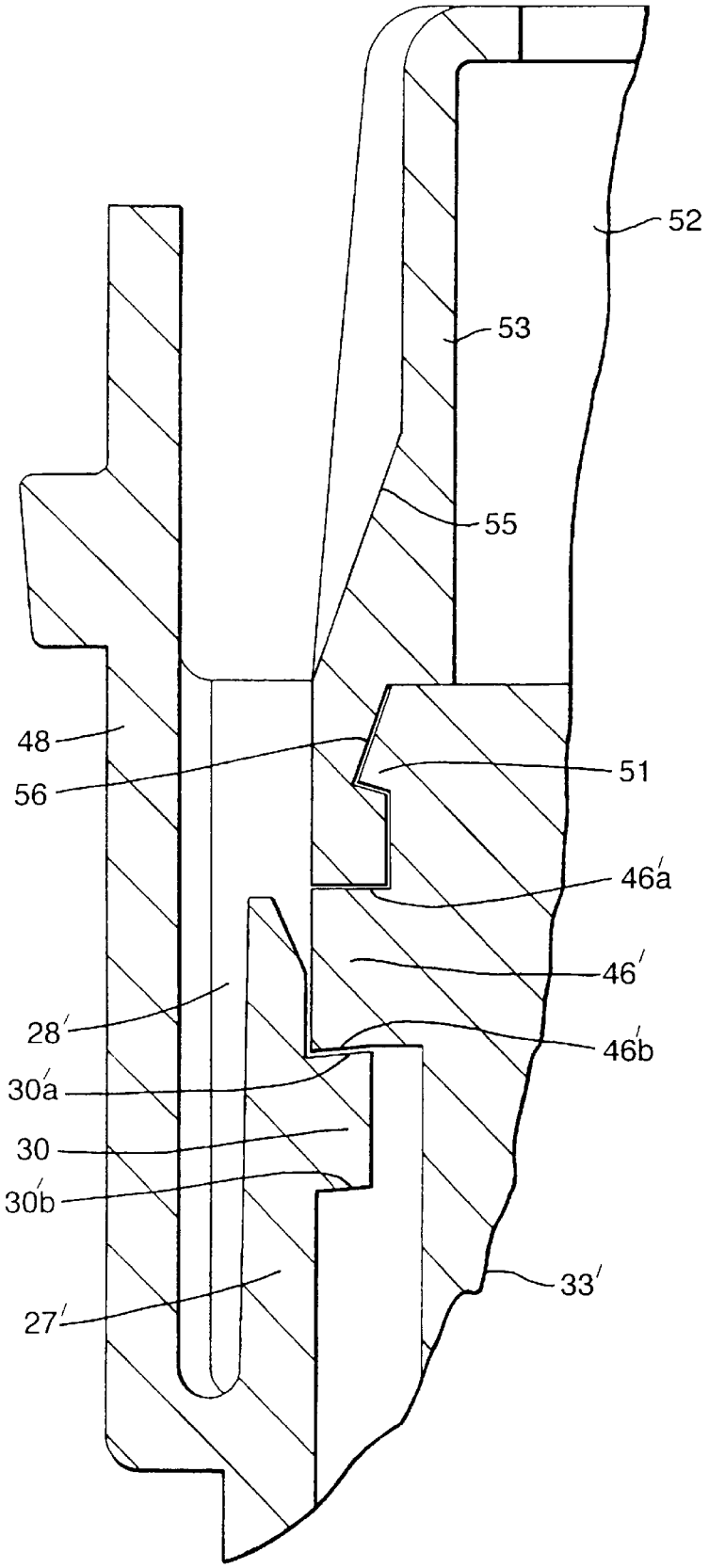
FIG. 10 is an enlarged detail which makes clear the combined action of the engagement between the cover cap, plug-in module and housing.

The plug 1 and mating connector 3, 3' reproduced in FIGS. 1 to 9 are illustrated in an enlarged scale of 2.5:1 while FIG. 10 corresponds to a scale of about 5:1. The plug 1 and the mating connector 3, 3' are usually manufactured from plastic materials, such as eg polyamide.

In order to maintain clarity the illustration of contact parts was deliberately dispensed with in the figures so that exclusively the characteristics and functions according to the invention become clear. Uniquely in FIG. 7 the illustration has been chosen with contact parts (10, 10*a*, 57) fitted to leads and sealed in part with individual seals.

Figure 1:
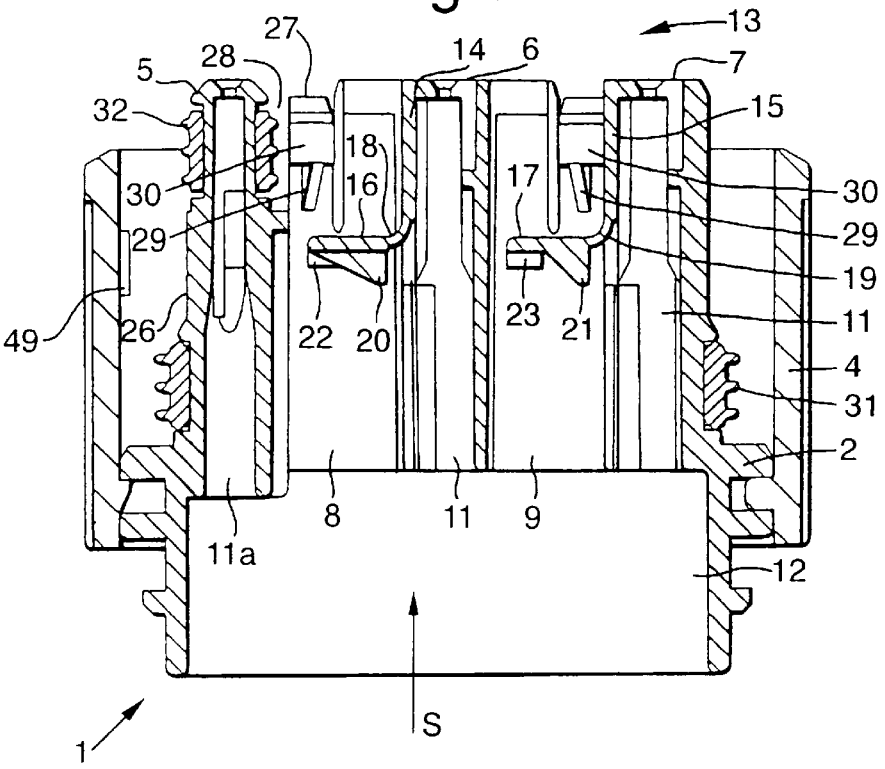
FIG. 1 is a longitudinal section through an unequipped plug with outer housing and seals.
Figure 2:
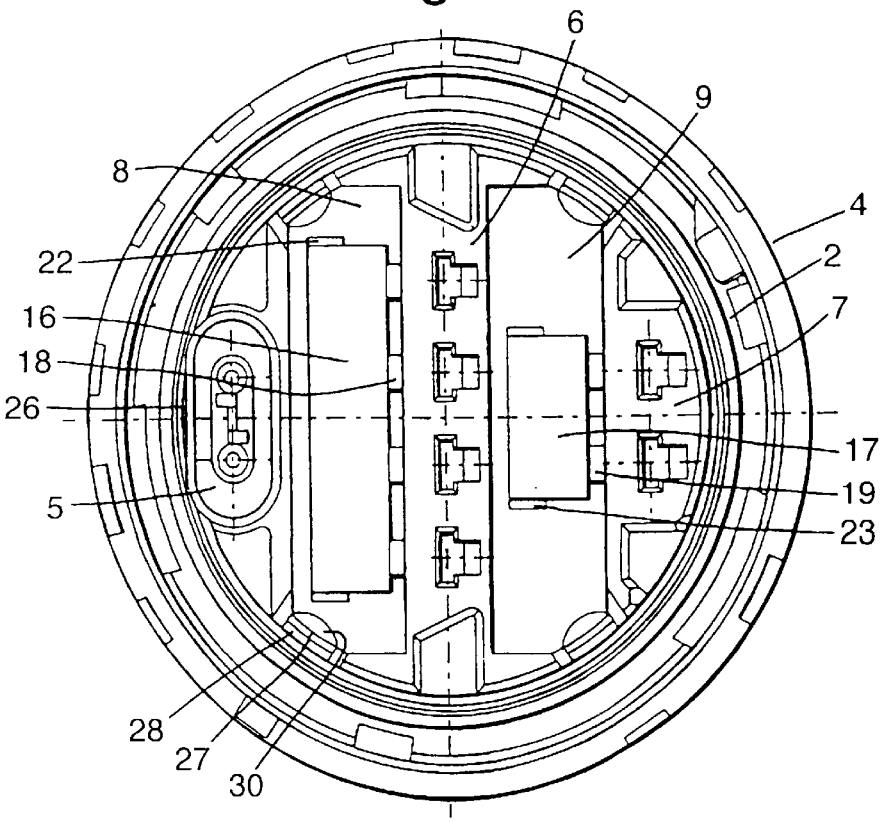
FIG. 2 is a view of the plug-in side of the plug.
Figure 7:
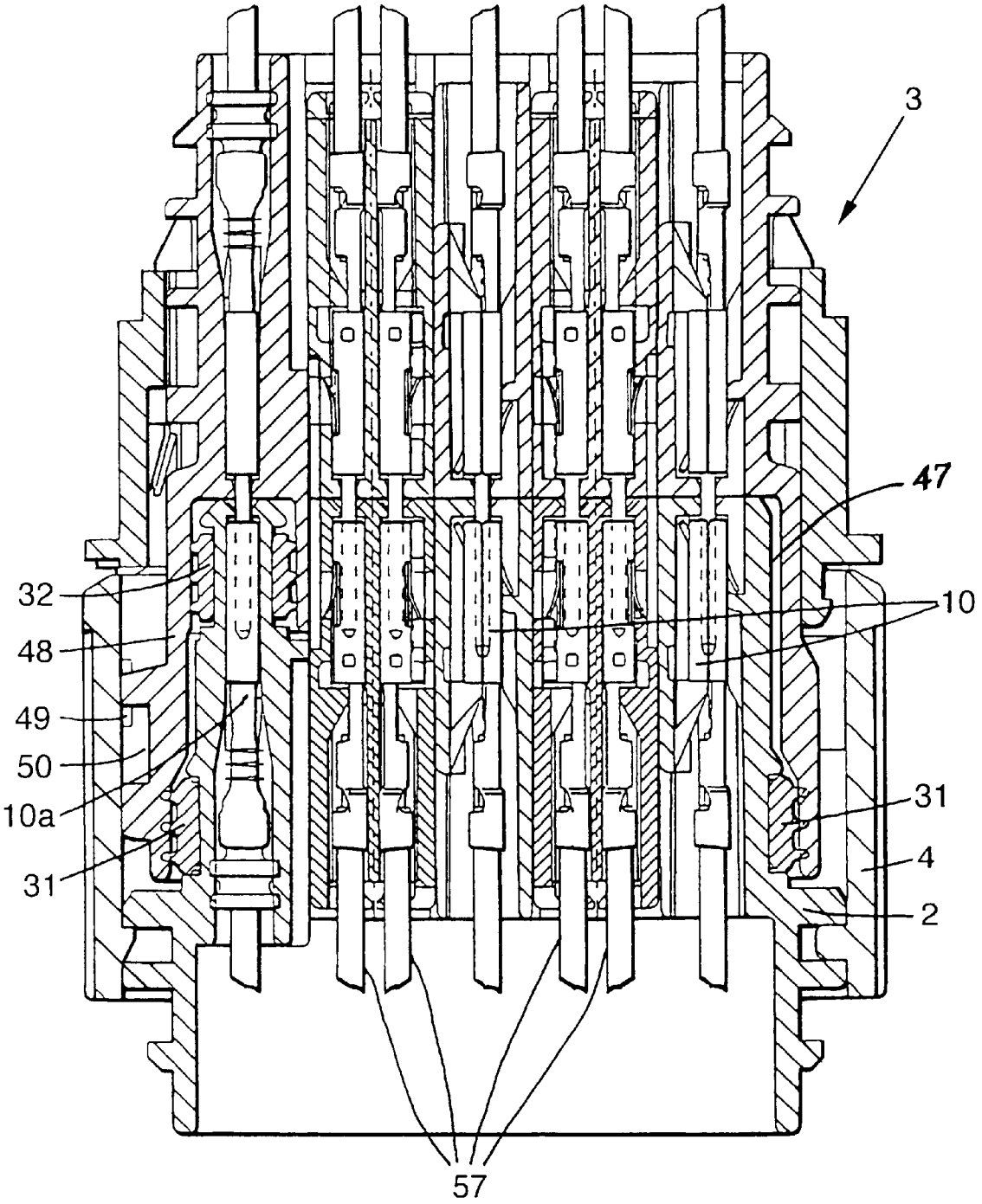
FIG. 7 is a longitudinal section through a plug connector composed of plug and mating connector equipped with contact parts and plug-in modules.

The plug 1 illustrated in longitudinal section in FIG. 1 consists of a cylindrical housing 2, which is equipped for connection with a mating connector 3 shown in FIG. 7, having an outer housing 4 engaged on it which in this case is a sleeve-like screw-fitting ring. Inside the housing 2 are located a safety module 5, two housing modules 6, 7 and two hollow spaces 8, 9 which are arranged parallel to one another. The safety module 5 and the housing modules 6, 7 are constructed in the same material integrally with the housing 2 and are each traversed by a series of contact part cavities 11, 11*a* for the accommodation of contact parts 10, 10*a* (FIG. 7). The contact parts 10, 10*a* are inserted in the contact part cavities 11, 11*a* from a rearward insertion region 12 in the plug-in direction S to form a front-end connection region 13. On their longitudinal walls 14 and 15 facing towards the hollow spaces 8 and 9 the housing modules 6 and 7 each have a flap 16, 17 which is pivotable outwardly in the plug-in direction S. The flaps 16, 17 are pivoted on the longitudinal wall 14, 15 by a film hinge 18, 19 and have lugs 20, 21 for each contact part cavity 11. Latching means 22, 23 are located on the flap 16, 17 opposite the film hinge 18, 19. Complementary catches 24, 25 are provided on the housing modules 6, 7.

On the housing wall 26 close to the connection region 13 the hollow spaces 8 and 9 between the housing modules 6 and 7 each have two opposite arms 27 which can be deflected elastically into an open space 28 located between the housing wall 26 and the arm 27. The arms 27 have each an inwardly directed ramp 29 rising in the plug-in direction S which passes over into a projecting notch 30.

The safety module 5 visible on the left in the figures serves especially for the reception of contact parts 10*a* which are integrated into the power supply of an air bag system. The contact part cavities 11*a* of this safety module 5 are not equipped with flaps. The safety module 5 is formed in part by the housing wall 26. Apart from a seal 31 completely encompassing the housing 2 the safety module 5 is additionally sealed at the front by a separate module seal 32. Thus in this region of the housing wall 26 there is a double seal arranged one behind the other.

Figure 3:
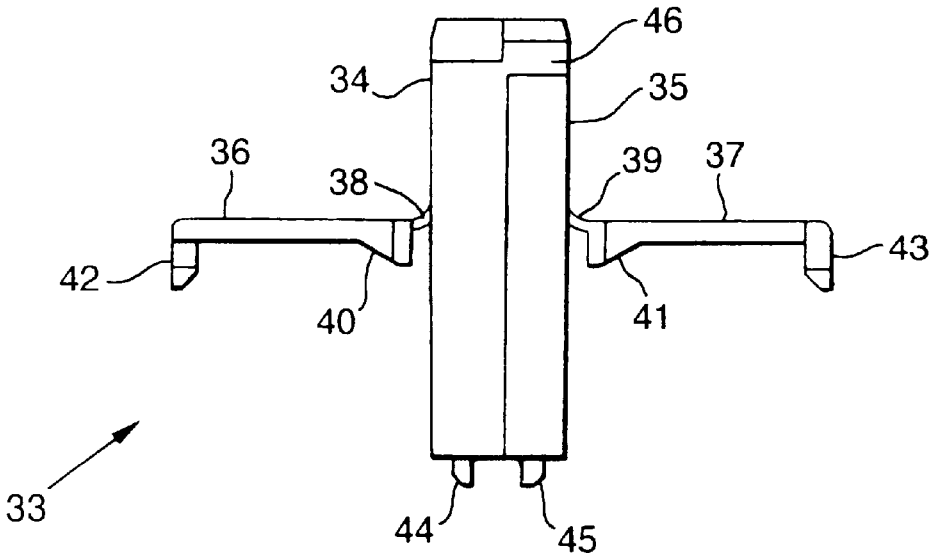
FIG. 3 is a side elevation of an unequipped plug-in module with open flaps.
Figure 4:
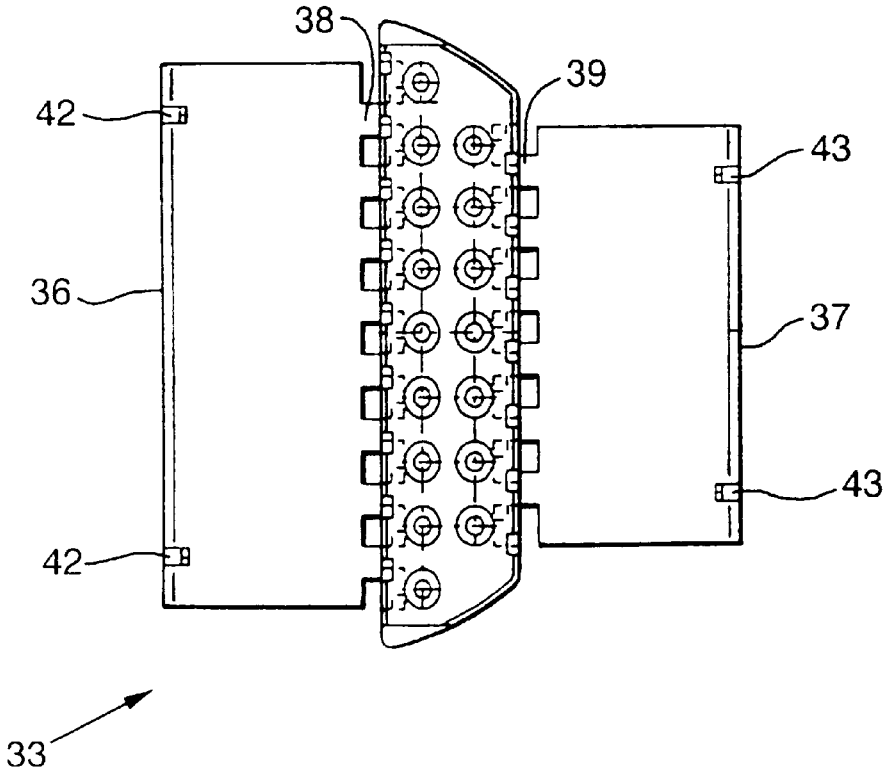
FIG. 4 is a plan view of the plug-in module.
Figure 5:
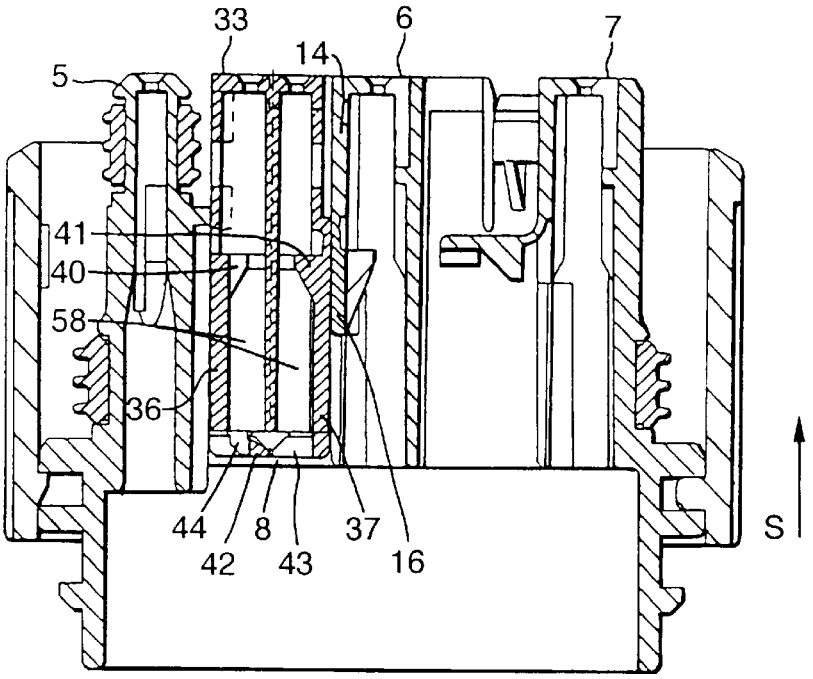
FIG. 5 is a longitudinal section through the plug equipped with a plug-in module.
Figure 6:
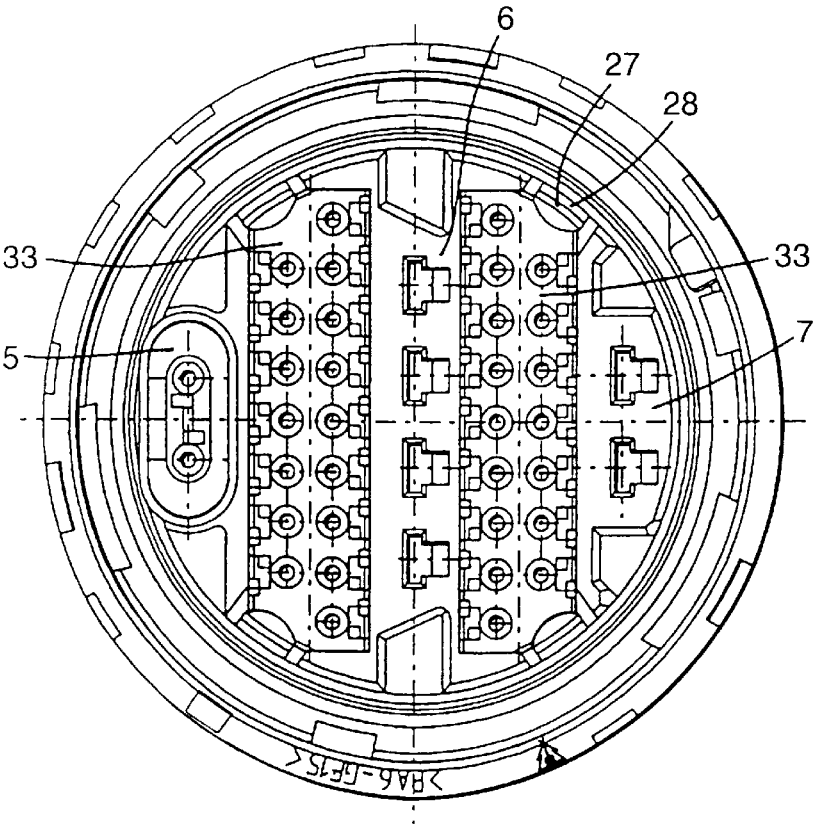
FIG. 6 is a view of the plug-in side of the plug according to FIG. 5, both plug-in modules being inserted.

The hollow spaces 8 and 9 serve for the reception of plug-in modules 33 (FIGS. 3 and 4). The plug-in modules 33 are constructed as a matter of principle in rectangular manner and traversed by two parallel rows of contact part cavities 58. The neighboring outer longitudinal walls 34 and 35 parallel to the rows of contact part cavities each have a flap 36, 37 which can be swung out in the plug-in direction S. These flaps 36, 37 are connected to the longitudinal walls 34 and 35 via film hinges 38, 39. On one of the flaps 36, 37 an inwardly directed lug 40, 41 in the vicinity of the film hinges 38, 39 is assigned to each contact part cavity 58. On each flap 36, 37 opposite the film hinges 38, 39 two inwardly oriented clips 42, 43 are constructed which correspond to complementary pins 44, 45 on the plug-in module 33.

In what follows the assembly and the combined action of the individual parts of the plug 1 are described by way of example. In the plug-in modules 33 (FIG. 3) delivered with open flaps 36, 37 contact parts 57 are pushed in until an initial locking mechanism which is not shown engages. The flaps 36, 37 are subsequently swivelled manually or automatically counter to the plug-in direction S into the longitudinal walls 34 and 35 and the clips 42, 43 and the pins 44, 45 engage with one another. In doing so, the lugs 40, 41 of the flaps 36, 37 engage behind an edge of the contact parts 57 and represent a secondary locking mechanism. With the pushing in of the flaps 36, 37 or of the lugs 40, 41 almost completely introduced contact parts 57 can be advanced into their correct position. The flaps 36, 37, however, cannot be closed as long as a contact part 57 has not been introduced far enough. In this case a corresponding correction is required.

In parallel with this the contact parts 10 are inserted into the housing modules 6 and 7 in the housing 2, their mode of operation corresponding to the aforementioned description. The swivelling of the flaps 16 and 17 is, however, only possible by indirect means. An appropriate tool (not illustrated) which is operated manually or automatically, is introduced into the hollow spaces 8 and 9 from the connection region 13 and closes the flaps 16 and 17. Ideally the cross section of the tool corresponds to the cross section of the hollow space 8 or 9 in order to guarantee a flawless movement sequence. The tools can be combined to form a tool unit so that only a single procedural step is necessary for the swivelling and locking of the flaps 16 and 17.

Only after the housing modules 6 and 7 are completely sealed in the housing 2 is it possible to introduce the plug-in modules 33 into the hollow spaces 8 and 9. Otherwise, incompletely swivelled flaps 16, 17 would prevent the insertion of the plug-in modules 33 and thus indicate a corresponding error. The prerequisite for this purpose is form locking between the cross sections of the plug-in modules 33 and the respective hollow spaces 8, 9. The form locking also makes it possible for an incompletely engaged flap 36, 37 on a plug-in module 33 to engage later during introduction. Contact parts 57 in the plug-in module 33 which have been introduced far enough are the prerequisite, since otherwise a blockage would arise here too. During the introduction of the plug-in modules 33 into the hollow spaces 8, 9 contact is made with the ramps 29 of the arms 27 so that the arms 27 are deflected into the open spaces 28. The complete insertion of a plug-in module 33 is indicated by an elastic snapping back of the arms 27, the notches 30 audibly, and from the connection region 13 visibly, engaging behind the projections 46 on the plug-in module 33.

After the complete fitting of the plug 1 with contact parts 10, 10*a* and plug-in modules 33 including the attachment of the two seals 31 and 32 can the connection to the mating connector 3 (FIG. 7) take place. The plug 1 is inserted in a cup-shaped connection region 47 of the mating connector 3. In doing so the wall 48 of the connection region 47 is guided between housing wall 26 and the outer housing 4 of the plug 1. Inside the outer housing 4 has a cam 49 which engages in an outside thread 50 of the wall 48 of the mating connector 3 so that by turning the outer housing 4 the plug 1 and the mating connector 3 are pulled together (bayonet closure).

The double use of the housing wall 26 of the housing 2 as a sealing surface simplifies the structural make-up of the connection region 13 and supports the initial centering especially of round plug-in systems. The peripheral arrangement of the safety module 5 also simplifies the design of the connection region 47 in the mating connector 3 since the wall 48 is also used.

In FIGS. 8 to 10 a second embodiment of the plug connector, in this case of a mating connector 3', is illustrated. In this case the principle of modular construction including the locking mechanisms for the contact parts remains unchanged. Comparable units are identified with the same reference number and an additional apostrophe. The housing 2' of the mating connector 3' is likewise equipped at the front with flexible arms 27' which can be deflected elastically into open spaces 28' located between the wall 48' and the arms 27'. On each of the arms 27' a rectangular notch 30' is formed which points into the adjoining hollow space 8' or 9'. The plug-in module 33' has projections 46' on both longitudinal walls 34' and 35'. Between the projections 46' and the connection region 13' a circular wedge-shaped rib 51 is located on the plug-in module 33'.

An additional component of this embodiment is a cover cap 52. The cover cap 52 serves as a continuation of the plug-in module 33' in the plugging direction S and has a corresponding rectangular shape. Inside the cover cap 52 is hollow and rectangular while outside the side walls 53, 54 are inclined slightly inwards in the plug-in direction S and have additional slopes 55. Inside the cover cap 52 is constructed with a V-shaped circulating groove 56.

In what follows the combined action of the individual units is described. The cover cap 52 is plugged on to the unequipped plug-in module 33'. In doing so the groove 56 and the rib 51 engage in one another by snap-action. Subsequently the plug-in module 33' is equipped with contact parts, preferably with contact pins, and initially and secondarily locked in the known manner. Contact pins projecting out of the connection region 13' are thus surrounded by the cover cap 52 and protected against mechanical stresses. After the housing modules 6' and 7' are fitted out and the flaps 16' and 17' closed the plug-in modules 33' can be introduced into the hollow spaces 8', 9'. The inwardly inclined side walls 53 and 54 of the cover cap 52 facilitate the introduction while the maximum extension corresponding to the profile of the hollow spaces 8', 9' ensures trouble-free advancement. The slopes 55 on the side walls 53 and 54 deflect the arms 27' with the notches 30' into the open spaces 28'. Once the projections 46' of the plug-in module 33' have passed the notches 30' the arms 27' snap back elastically. In doing so the notches 30' engage behind the projections 46' by their edges 30'*a* and 46'*b* lying on one another and preventing withdrawal of the plug-in module 33' out of the housing 2'. During the assembly process the contact parts are protected against external influences. Immediately before the connection of a plug to the mating connector 3' the cover cap 52 is pulled off. Since the rib 51 and the groove 56 between the cover cap 52 and the plug-in module 33' are bevelled on both sides the cover cap 52 can be removed without great effort. The cover cap serves as a tool and depending on the material employed can frequently be used again. The essential feature in this embodiment is that the plug-in module 33' cannot be pushed completely into the hollow space 8' or 9' without the cover cap 52 since the edges 30'*b* of the notches 30' and the edges 46'*a* of the projections 46' push against one another and further advancement of the plug-in module 33' is prevented by the arm 27' not being deflected.

What is claimed is:

1. A modular plug connector that can be connected to a mating connector, in a plug-in direction comprising:

a housing that has a hollow space and a housing module that is formed of the same material integrally with the housing and that has contact cavities oriented in the plug-in direction for receiving contacts, the modular plug connector having a plug-in module that is inserted into the housing module sliding along the housing module in the plug-in direction and disposed in the hollow space, the plug-in module having contact cavities oriented in the plug-in direction for receiving contacts, and the housing module and the plug-in module each having a longitudinal wall with a flap that is swivable outwardly in the plug-in direction to an open position, and inwardly to a closed position flush with the longitudinal wall, and the contacts being fixed in the contact cavities by means of lugs constructed on the flaps when the flaps are in the closed position.

2. The modular plug connector as defined in claim 1 wherein the plug-in module can be inserted into the housing module and disposed in the hollow space only if the flap of the housing module is in the closed position.

3. The modular plug connector as defined in claim 2 wherein the opposite longitudinal walls of the plug-in module each have one of the flaps.

4. The modular plug connector as defined in claim 2 wherein the flaps of the housing modules can be swiveled counter to the plug-in direction by means of a tool.

5. The modular plug connector as defined in claim 2 wherein the plug-in module is fastened detachably to the housing by a flexible cantilever arm having a notch engaging a projection of the plug-in module.

6. The modular plug connector as defined in claim 5 wherein the flexible cantilever arm has a ramp that runs counter to the plug-in direction in a manner reducing the cross section from the notch of the arm.

7. The modular plug connector as defined in claim 1 wherein a cover cap is engaged upon a connection region of the plug-in module before the plug-in module is introduced into the hollow space.

8. The modular plug connector as defined in claim 7 wherein the cover cap has a slope that cooperates with the notch of the arm.

9. The modular plug connector as defined in claim 1 wherein a seal surrounds the housing wall of the housing, an additional safety module is constructed integrally of the same material in the housing and a separate module seal is provided in the connection region.

10. The modular plug connector as defined in claim 9 wherein the safety module includes an extension of the housing wall of the housing.

11. The modular plug connector as defined in claim 1 wherein auxiliary means are provided for connecting the modular plug connector and the mating connector.

12. The modular plug connector as defined in claim 2 wherein the modular plug connector and the mating connector are round.

13. The modular plug connector as defined in claim 2 wherein the modular plug connector and the mating connector are rectangular.

* * * * *